US005836453A

United States Patent [19]

Herrera

[11] Patent Number: 5,836,453

[45] Date of Patent: Nov. 17, 1998

[54] CABLE POUCH HAVING MEDICAL APPLICATIONS

[76] Inventor: Jazmin V. Herrera, 9300 Raintree Rd., Burke, Va. 22015

[21] Appl. No.: 845,420

[22] Filed: Apr. 25, 1997

[51] Int. Cl.[6] ..... B65D 85/00

[52] U.S. Cl. ..... 206/702; 206/702; 383/38; 5/503.1

[58] Field of Search ..... 383/38, 39; 5/503.1, 5/658, 53.1; 206/702

[56] References Cited

U.S. PATENT DOCUMENTS

| | | | |
|---|---|---|---|
| 4,074,397 | 2/1978 | Rosin . | |
| 4,336,806 | 6/1982 | Eldridge, Jr. . | |
| 4,431,154 | 2/1984 | Hamm | 5/503.1 |
| 4,640,032 | 2/1987 | Lewis . | |
| 5,082,111 | 1/1992 | Corbitt, Jr. et al. . | |
| 5,335,677 | 8/1994 | Busch . | |
| 5,464,025 | 11/1995 | Charles et al. . | |
| 5,581,829 | 12/1996 | Lee | 383/39 |
| 5,699,564 | 12/1997 | Heh | 5/503.1 |

*Primary Examiner*—Paul T. Sewell
*Assistant Examiner*—Jila Mohandesi
*Attorney, Agent, or Firm*—Richard C. Litman

[57] ABSTRACT

A pouch for organizing and suspending cables off of a hospital floor. The pouch comprises three distinct, integrally connected sections that cooperate in an envelope-like formation to enclose a plurality of cables. Two pockets integrally connect to the front side. Upon relocating a patient, the cables are unplugged and stored within the pouch, with the plugs contained within the pockets to prevent damage to the cables and plugs, and to avoid dragging the plugs along the floor. A pair of ties engages the back side of the pouch, each employing mating strips having complimentary hook and loop fasteners, to secure the pouch onto patient carriers at a significant height above a hospital floor. An assembly of interlocking bands and straps, each having complimentary hook and loop fasteners, cooperate to secure a plurality of cables in place within the pouch. The pouch can be opened while secured onto a patient carrier to access cables therein, and the ties can be quickly disengaged to transfer and relocate the pouch when necessary to do so.

5 Claims, 3 Drawing Sheets

CABLE POUCH HAVING MEDICAL APPLICATIONS

BACKGROUND OF THE INVENTION

1. Field of the Invention

The present invention relates to a pouch for safely and unobtrusively containing cables in hospital settings, and more specifically to a pouch enclosure that secures cables and/or wires therein, removably engages an incubator or a hospital bed, and facilitates the unencumbered, safe and rapid movement of medical equipment in normal or emergency situations.

2. Description of the Related Art

The organization of medical equipment is paramount to best coordinating and orchestrating patient care in hospitals. Many inventions and patents involve the stationary placement of medical equipment during surgery. Specifically, surgical instruments, tubes having life-support applications and electrical cables leading to the machines used during surgery warrant devices for securing such medical equipment in place. U.S. Pat. No. 4,074,397, for example, discloses a disposable pad having a pressure-sensitive adhesive on one side and an elongated flexible strip having VELCRO that wraps around a medical tube and removably engages the non-adhesive surface of the pad to secure the tube in place.

The disposable surgical instrument holder of U.S. Pat. No. 5,082,111 comprises a base member and a plurality of cooperating VELCRO flaps that releasably attach to the base member to secure instruments, tubes or cables in place.

U.S. Pat. No. 4,336,806 discloses a medical tubing holder that incorporates magnetic members to secure tubing within the folded holder, and adhesive on the outside of the holder to further immobilize medical tubing.

A self-contained surgical tubing management system is described in U.S. Pat. No. 5,464,025, whereby all of the required surgical tools and tubes, cables and connections are incorporated in a single disposable package. The system includes a sheet that covers at least part of a patient's body and pockets that hold surgical instruments and the coiled ends of power and fluid lines, which extend along the length of the sheet and are secured thereto.

U.S. Pat. No. 5,335,677 discloses a surgical drape having a pocket for accessories as well as devices to adhere instruments in place and to secure it to an operating table or other patient support structure.

Each of the inventions and patent described above deals exclusively with surgical applications, including tubing, drapes and surgical instruments. The stationary nature and relatively limited duration of most surgical procedures, however, distinguishes the operating room from other hospital settings such as the Intense Care Unit (ICU), the Coronary Care Unit (CCU) and the Neo-Natal Infant Care Unit, where the patient undergoes an extended stay and must often be transported to and from other areas of the hospital. These settings therefore warrant a more mobile system of containing life-supporting tubes and electrical cables that is commensurate with physically transient and long-term hospital care.

The cable organizing sleeve of U.S. Pat. No. 4,640,032 comprises two opposingly-disposed sheets of similarly-dimensioned flexible material. The interior facing surface of each of the sheets engages a plurality of complimentary VELCRO strips that run along the length of the sleeve. When aligned, the sheets sandwich a plurality of cables, each contained within a compartment defined by the two sheets and two consecutive pairs of mated complimentary VELCRO strips.

The organizing sleeve of '032, while not specifically designed for medical applications, recognizes the general need for organization of a set of electrical cables. An entangled plurality of cables extending from collocated electrical equipment complicates maintenance procedures, making it confusing, difficult and time-consuming to trace a specific cable to disconnect and service the corresponding piece of equipment. Furthermore, disorganized cable masses present safety hazards, where a person's foot could become entangled, potentially leading to a serious injury and to the yanking of the cables, with resultant damage to the electrical equipment that is suddenly and forcefully unplugged when the person falls or struggles. Also, large cable masses present an ugly and disconcerting appearance.

In hospital settings such as the ICU, the CCU and the Neo-Natal Infant Care Unit, additional concerns make cable organization vital. The patients being cared for in these specialized units, including premature infants, must often undergo immediate transfer in emergency or other life-threatening situations. It is therefore critical to employ a cable organizing device having features that allow portability, for instances where an incubator/isolette or specialized bed carrying a patient must be transported. In these cases, certain medical equipment must be temporarily unplugged, necessitating proper storage that avoids damage to the plugs of the cables. The cable organizing device of '032 lacks pockets, slits or other storage means for safely containing cable plugs during transit.

Moreover, the organizing device of '032 does not suggest a way to suspend or support the plurality of cables, once contained, so that they do not lie on the floor. Floor-bound cables, even in an untangled state, present a potentially dangerous situation, especially in a hospital setting where doctors, nurses and hospital staff must often relocate patient carriers and other medical equipment. The obstacle that cables lying on a hospital floor creates, whether the cables are tangled or organized in a sleeve according to the device of '032, impedes the rapid transportation of wheeled objects which frequently figure prominently in the delivery of urgent patient care and emergency evacuation procedures. Accordingly, proper cable organization and placement becomes a matter of life and death in these cases.

Cables that stay on the floor for prolonged periods also incur damage from being stepped on and rolled over repeatedly, requiring earlier repair or replacement. In addition, the placement of cables on the floor, whether strewn about or aligned in a sleeve according to the device of '032, complicates sweeping, mopping, waxing and other floor-related tasks of hospital cleaning personnel, ultimately leading to compromised sanitary conditions. Such conditions are conducive to the increased proliferation of bacteria and other infectious agents, resulting in potentially fatal consequences for premature infants, ICU patients and others whose poor state of health and corresponding lowered immune resistance make them much more susceptible to contagion.

There is therefore a need for a cable pouch having medical applications that organizes and secures cables in place while incorporating features that make the pouch portable and easy to relocate. There is also a need for a pouch that organizes a plurality of cables while simultaneously keeping them off of the floor.

None of the above inventions and patents, taken either singly or in combination, is seen to describe the instant invention as claimed.

SUMMARY OF THE INVENTION

The proper organization and optimal placement of electrical cables is intended to avoid a tangled heap lying haphazardly on the floor in the proximity of collocated electrical equipment. Such disorganized cable masses make it confusing, difficult and time-consuming to trace a specific cable, and present an ugly and disconcerting appearance. Tangled floor-bound cables also present safety hazards, where a person can trip and fall, incurring injury to themselves and in the process damaging the electrical equipment that is suddenly and forcefully unplugged.

Cable organization is vital in medical patient care facilities. The patients being cared for in specialized units must often undergo immediate transfer in life-threatening situations, making portability a critical feature for cable organizing devices. During patient transport, certain medical equipment must be temporarily unplugged, necessitating proper storage that avoids damage to the plugs of the cables. Floor-bound cables, even in an untangled state, impede the rapid transportation of wheeled objects during the delivery of urgent patient care and emergency evacuation procedures, thereby presenting a safety hazard that makes proper cable organization and placement a literal matter of life and death.

Cables that stay on the floor for prolonged periods also incur damage from being stepped on and rolled over repeatedly, requiring earlier repair or replacement. The placement of cables on the floor also leads to compromised sanitary conditions, as cleaning sections of the floor under the cables is considerably more difficult. Consequently, these sections are not cleaned as often or as thoroughly, leading to higher levels of bacteria and other infectious agents that result in more contagious conditions, to which hospital patients are more susceptible.

The pouch of the present invention organizes cables that extend from medical devices used in patient care, and keeps them elevated high off of the hospital floor to provide a safer, cleaner environment having a more professional appearance. The cable suspension feature of the pouch also affords the unhampered delivery of urgent patient care and the effective and timely emergency evacuation of carrier-bound patients.

The pouch is preferably manufactured from one piece of medical-grade, odorless, hypoallergenic, heat-resistant, water-resistant flexible material that is easy to clean and does not accumulate dust. The pouch comprises three distinct, integrally connected sections; a substantially rectangular front side, a substantially rectangular back side and a substantially trapezoidal flap. Two substantially rectangular pockets integrally connect to the right and left ends of the front side. Upon relocating a patient, the cables are unplugged and stored within the pouch, with the plugs temporarily and securely contained within the pockets to ultimately prevent damage to the cables and plugs, and to avoid dragging the plugs along the floor during patient relocation. A pair of ties engages the upper right and left corners of the back side, each comprising two mating strips having an interior facing surface that is lined with complementary hook and loop fasteners, such as VELCRO brand. The ties engage the legs or rails of an infant isolette, crib, specialized hospital bed or other patient carrier. When aligned, the mating strips sandwich the legs or rails of the patient carrier to secure the pouch thereon.

The front and back sides and trapezoidal flap cooperate in an envelope-like formation to enclose a plurality of cables, with the back side folding up to meet the front side, and the flap overlapping the back side. Complementary hook and loop type fastener strips extend across the contacting surfaces of the back side and the flap, and facilitate the secure closure of the pouch.

Vertical hook and loop type fastener bands engage the interior of the pouch and a plurality of straps engage the interior of the pouch, along one of the shorter strap edges, so as to be on top of and collinear with the bands. Hook and loop type fastener on the straps allows them to removably engage the complementary hook and loop type fastener surface of one of the bands. Each of the straps pulls back and overlays one or more cables, so that the hook and loop type fastener-lined surfaces interlock to secure the cables in place. When all of the cables are secured in place, the back side of one of the sections is rotated inwardly along a fold line, towards the front side, and the flap is rotated inwardly towards the body of the pouch. When the flap is proximate to the back side, the complementary hook and loop type fastener strips are mated to enclose the cables within the pouch. The pouch can be opened while secured onto a patient carrier to access cables therein, and the ties can be quickly disengaged to transfer and relocate the pouch when necessary to do so.

Accordingly, it is a principal object of the invention to provide a cable pouch having medical applications that organizes and secures cables in place.

It is another object of the invention go incorporate features that make the pouch portable and easy to relocate.

It is a further object of the invention to include pockets for securely containing cable plugs during patient relocation.

Still another object of the invention is to maintain a plurality of cables at a significant height above a hospital floor.

It is also an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
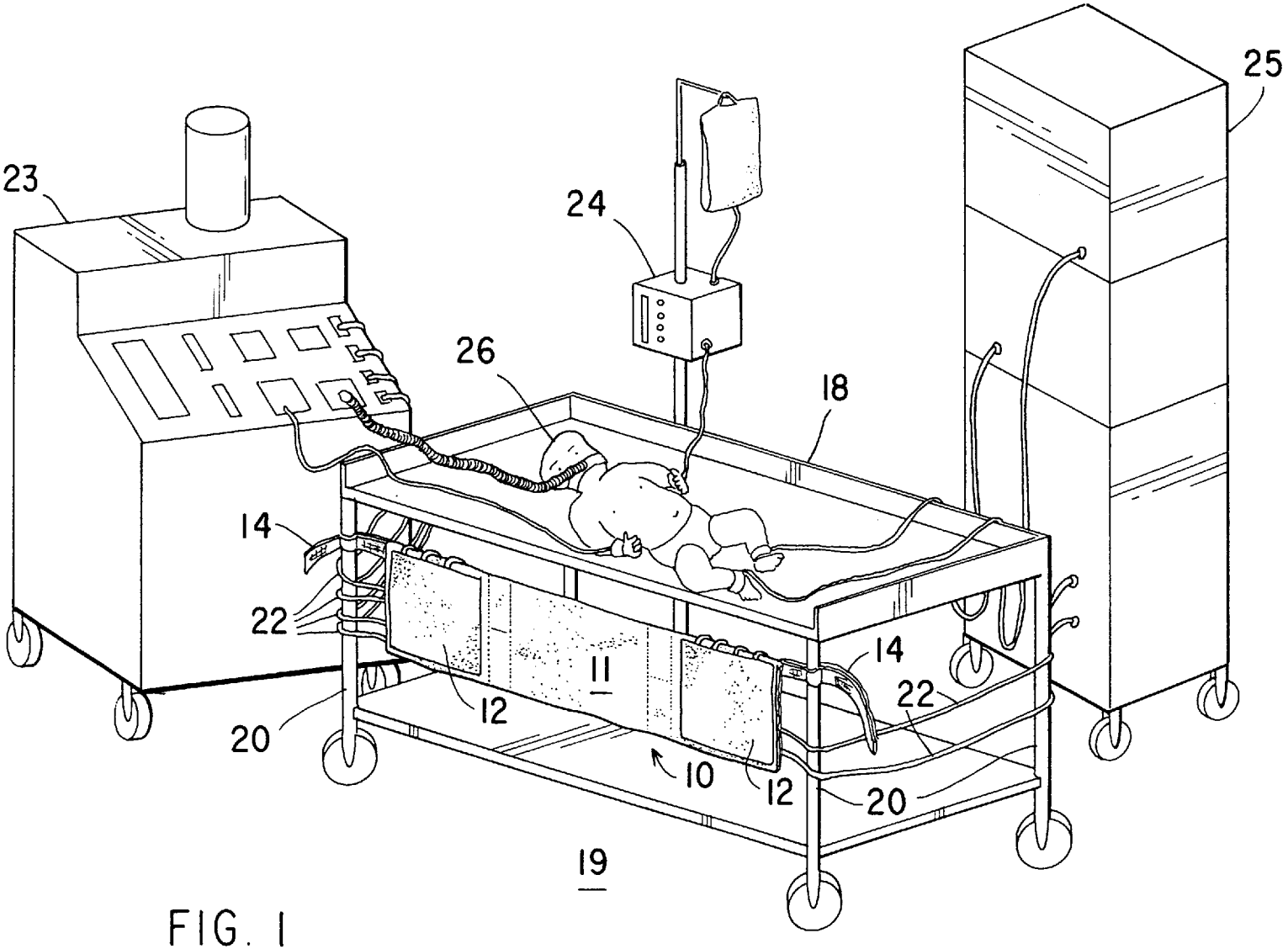
FIG. 1 is an environmental view of the present invention, as employed in a Neo-Natal Infant Care Unit.
Figure 2:
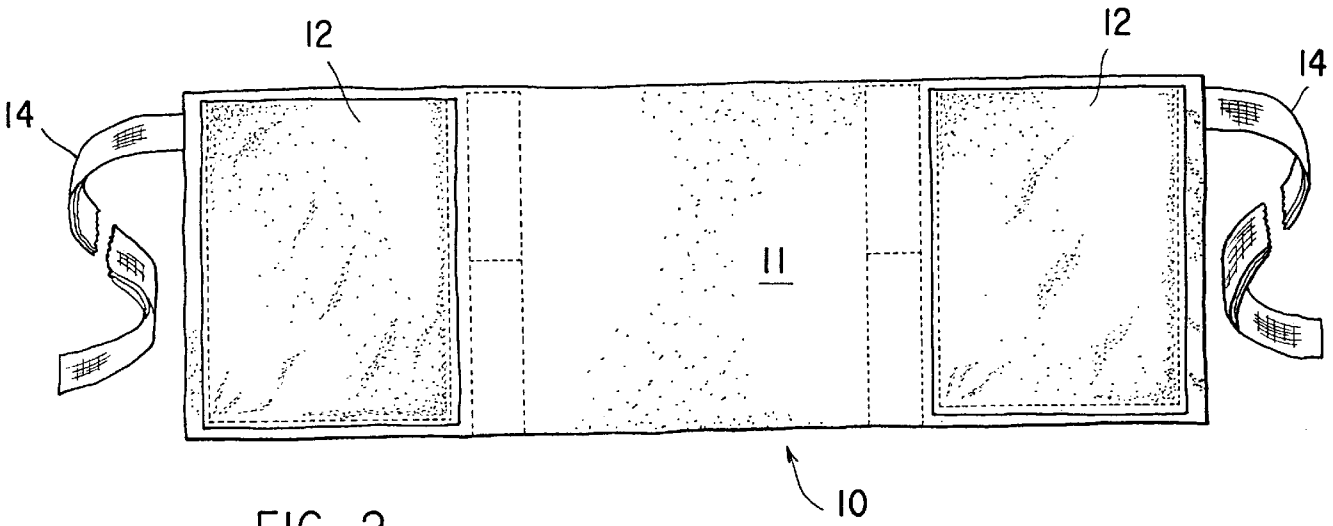
FIG. 2 is a front perspective view of the present invention.
Figure 3:
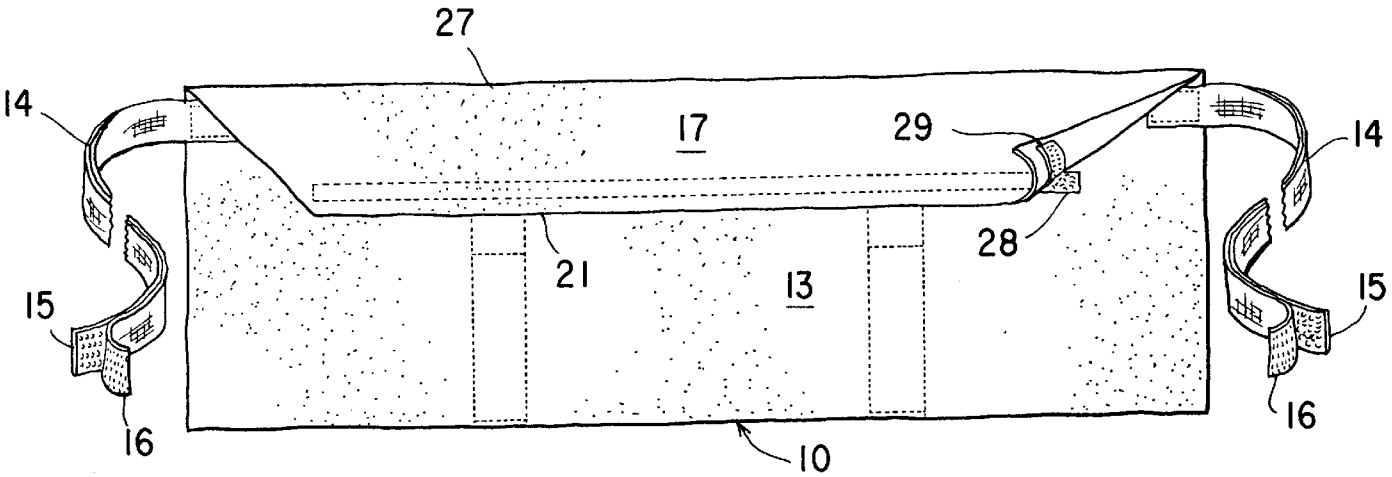
FIG. 3 is a back perspective view of the present invention as it appears partially opened.

The present invention, referenced by 10 herein, is illustrated in FIG. 1 as employed in a Neo-Natal Infant Care Unit. The cable pouch 10, when folded, is substantially rectangular, and comprises two substantially rectangular pockets 12, which integrally connect to the right and left ends of the front side 11 thereof, as also shown in FIG. 2. Pouch 10 also includes a pair of ties 14 that engage the upper right and left corners thereof. In the preferred embodiment of the invention, each of ties 14 comprises two mating strips 15,16, as shown in FIG. 3. The interior facing surface of each of strips 15,16 is lined with complementary hook and loop fasteners, such as VELCRO brand. FIG. 1 shows how ties 14 are secured to the legs of an infant isolette 18, or crib, to support pouch 10 thereon. When aligned, mating strips 15,16 sandwich the legs 20 of isolette 18, keeping pouch 10 in place with front surface 11 facing outward.

FIG. 1 further illustrates pouch 10 containing the electrical cables 22 that extend from the medical devices 23,24,25 used in the life support, nourishment and care of the infant 26 while monitored in isolette 18. Pouch 10 organizes the cables 22, and keeps them elevated high off of the hospital floor 19 by virtue of ties 14 that secure pouch 10 to the legs 20 of isolette 18. By maintaining cables 22 at a height significantly above the hospital floor 19, pouch 10 provides a safer, cleaner environment having a more professional appearance. Furthermore, the cable suspension feature of pouch 10 better equips a patient care facility and its employees for the unhampered delivery of urgent patient care and the effective and timely emergency evacuation of carrier-bound patients. Ties 14 can also secure pouch 10 to other patient carriers, including incubators and specialized hospital beds for ICU and CCU patients.

Pouch 10 simplifies patient transportation, when medical care is to be rendered in another part of the hospital, or when an emergency situation requires the sudden evacuation of all hospital personnel and patients. Upon relocating a patient, cables 22 are unplugged and stored within pouch 10, and the plugs of cables 22 are temporarily and securely contained within pockets 12. This prevents any damage to cables 22 or the plugs thereof, and reduces the risk of injury resulting from dragging the plugs along the floor during patient relocation.

Now referring to FIG. 3, the back side 13 of pouch 10 engages a strip of hook and loop type fastener 28 that extends across it horizontally. Ties 14 engage the left and right corners of back side 13. The longest edge 27 of a substantially trapezoidal flap 17 integrally connects to front side 11 along the top edge thereof. Flap 17 engages a strip of hook and loop type fastener 29 that extends across it horizontally, proximate to the shorter edge 21 thereof. Flap 17 overlaps back side 13, whereby complementary hook and loop type strips 28,29 mate to enclosing a plurality of cables 22 within pouch 10.

Figure 4:
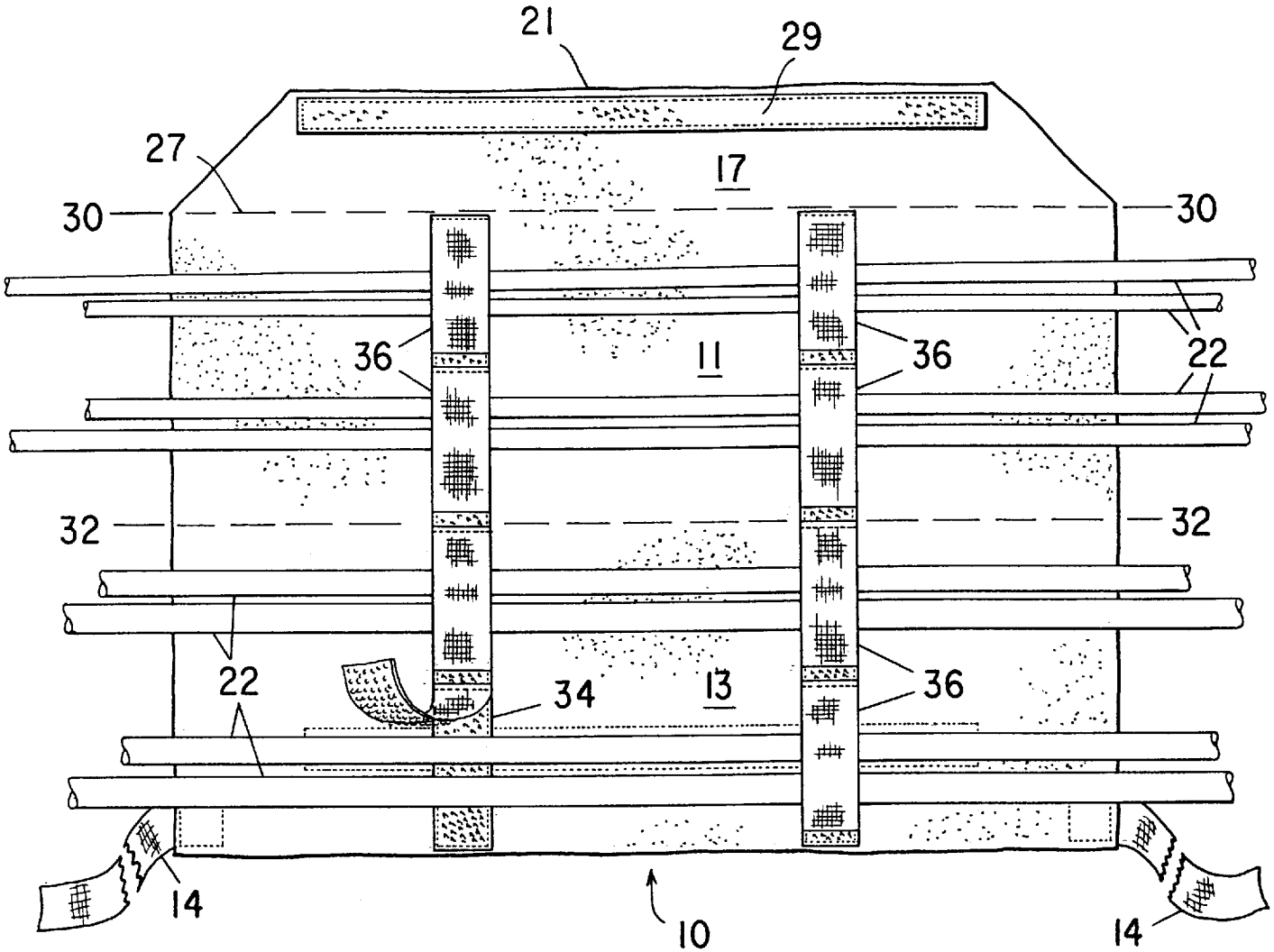
FIG. 4 is a perspective view of the present invention, as it appears opened and engaging a plurality of cables.

FIG. 4 illustrates the interior of pouch 10 in an open position. Pouch 10 is preferably manufactured from one piece of medical-grade, odorless, hypoallergenic, heat-resistant, water-resistant flexible material that is easy to clean and does not accumulate dust. The longest edge 27 of flap 17 integrally connects to front side 11 along the top edge thereof, along fold line 30. The bottom edge of back side 13, opposite to the edge engaging ties 14, integrally connects to front side 11 along the bottom edge thereof, along fold line 32. Vertical hook and loop type bands 34 engage the interior of front and back sides 11,13 at points approximately one third and approximately two thirds along the horizontal axis thereof. A plurality of straps 36, each having a width similar to that of bands 34, engages the interior of front and back sides 11,13, along one of the shorter strap edges, so as to be on top of and collinear with bands 34. Each of straps 36 includes hook and loop type fastener along the interior surface thereof, which mates with the complementary exposed hook and loop type fastener surface of one of bands 34. Pulling back strap 36 by the free end thereof, as shown in FIG. 4, allows the placement of one or more cables 22 along the interior surface or pouch 10, so as to be substantially perpendicular to bands 34. Strap 36 can then be placed over cables 22, so that the hook and loop type fastener-lined surface thereof engages the complementary exposed hook and loop type fastener surface of one of bands 34 to ultimately secure cables 22 in place between strap 36 and band 34. The arrangement of straps 36 along bands 34 effectively confines the totality of each individual strap 36 to the inner surface of either front side 11 or back side 13, so that none of straps 36 cross over from one side to another. Once straps 36 and bands 34 secure all of cables 22 in place, back side 13 can be rotated inwardly along fold line 32, towards front side 11. Once the interior surfaces of front and back sides 11,13 are adjacent, sandwiching cables 22 therebetween, flap 17 can be rotated inwardly along fold line 30, towards the body of pouch 10. When flap 17 is proximate to back side 13, complementary hook and loop type fastener strips 28,29 engage each other, and mate to enclose cables 22 within pouch 10. Pouch 10 can be opened while secured onto the legs or rails 20 of isolette 18 to access cable 22 therein, and ties 14 can be quickly disengaged to transfer and relocate pouch 10 when necessary to do so.

It is to be understood that the present invention is not limited to the sole embodiment described above, but encompasses any and all embodiments within the scope of the following claims.

I claim:

1. A cable pouch having medical applications comprising:

a piece of flexible sheet material having integrally connected sections, each of said sections having an interior surface and an exterior, said sections comprising:

a first substantially rectangular section having a first long edge and a second long edge;

a second substantially rectangular section having a first long edge and a second long edge with opposite ends; and a flap having a first edge and a second edge, said first edge being parallel to said second edge, said first edge of the flap being integrally attached to said first long edge of said first rectangular section to define a first fold line and said first long edge of said second rectangular section being integrally attached to said second long edge of said first rectangular section to define a second fold line;

a pair of ties attached at the opposite ends of said second long edge of said second rectangular section for securing said pouch above a floor to a patient carrier;

an assembly of interlocking bands and straps for securing a plurality of cables against said interior surface, said assembly of interlocking bands and straps vertically extending across the interior surface of said first rectangular section and said second rectangular section;

fastening means for removably securing said flap to said second rectangular section to enclose a plurality of cables within said pouch when said flap and said second rectangular section are inwardly folded along said first fold line and said second fold line, respectively; and a plurality of pockets on the exterior surface of said first rectangular section for securely containing a plurality of cable plugs.

2. The cable pouch according to claim 1, wherein each of said pair of ties includes two mating strips having interior facing surfaces lined with complementary hook and loop fasteners.

3. The cable pouch according to claim 1, wherein said assembly of interlocking bands and straps includes an arrangement of bands and straps having complementary hook and loop fasteners on opposing surfaces thereof, said straps being oriented on top of and collinear with said bands.

4. The cable pouch according to claim 1, wherein said fastening means for securing said flap to said second rectangular section comprises an interlocking set of first and second strips having complementary hook and loop fasteners thereon, said first strip being attached to the interior surface of said flap, and said second strip being attached to the exterior surface of said second rectangular section.

5. The cable pouch according to claim 1, wherein said flexible material is selected from the group consisting of medical-grade flexible material, odorless material, hypoallergenic material, fire-retardant material, water-resistant material and dust-repelling material.

* * * * *